US010854974B2

(12) United States Patent
Oh et al.

(10) Patent No.: US 10,854,974 B2
(45) Date of Patent: Dec. 1, 2020

(54) ANTENNA PORTIONS

(71) Applicant: Hewlett-Packard Development Company, L.P., Houston, TX (US)

(72) Inventors: Sung Oh, Palo Alto, CA (US); Philip Wright, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/772,180

(22) PCT Filed: Feb. 19, 2016

(86) PCT No.: PCT/US2016/018736
§ 371 (c)(1),
(2) Date: Apr. 30, 2018

(87) PCT Pub. No.: WO2017/142561
PCT Pub. Date: Aug. 24, 2017

(65) Prior Publication Data

US 2019/0067817 A1 Feb. 28, 2019

(51) Int. Cl.
*H01Q 1/24* (2006.01)
*H01Q 5/392* (2015.01)
(Continued)

(52) U.S. Cl.
CPC ..... *H01Q 5/392* (2015.01); *H01Q 1/2266* (2013.01); *H01Q 1/243* (2013.01); *H01Q 1/44* (2013.01); *H01Q 5/385* (2015.01); *H01Q 9/42* (2013.01)

(58) Field of Classification Search
CPC ..... H01Q 5/392; H01Q 1/44; H01Q 1/243; H01Q 1/2266; H01Q 5/385; H01Q 9/42
See application file for complete search history.

(56) References Cited

U.S. PATENT DOCUMENTS

2005/0168384 A1* 8/2005 Wang ..... H01Q 9/0421 343/700 MS
2012/0001815 A1* 1/2012 Wong ..... H01Q 9/0414 343/749

(Continued)

FOREIGN PATENT DOCUMENTS

CN 2750493 Y 1/2006
CN 101414705 4/2009

(Continued)

OTHER PUBLICATIONS

Ban, Y-L et al, "Low-Profile Printed Octa-Band LTE-WWAN Mobile Phone Antenna Using Embedded Parallel Resonant Structure", Jul. 2013.

(Continued)

*Primary Examiner* — Dimary S Lopez Cruz
*Assistant Examiner* — Bamidele A Jegede
(74) *Attorney, Agent, or Firm* — Brooks, Cameron & Huebsch, PLLC

(57) ABSTRACT

An antenna system, in one example implementation, can include antenna portions including a first portion of the antenna to receive a radio frequency (RF) signal. The antenna can include a second portion capacitively coupled to the first portion, wherein the capacitive coupling of the second portion to the first portion increases the high-band resonances. The antenna can include a third portion of the antenna connected to a connector. The third portion can be capacitively coupled to the first portion to excite wide low-band resonances and high-band resonances. The connector can be a ground for the third portion.

14 Claims, 4 Drawing Sheets

(51) Int. Cl.

| | |
|---|---|
| ***H01Q 9/42*** | (2006.01) |
| ***H01Q 5/385*** | (2015.01) |
| ***H01Q 1/44*** | (2006.01) |
| ***H01Q 1/22*** | (2006.01) |

(56) References Cited

U.S. PATENT DOCUMENTS

2012/0274538 A1* 11/2012 Tsou ..... H01Q 5/371 343/876
2013/0016013 A1* 1/2013 Wong ..... H01Q 1/38 343/700 MS
2013/0016024 A1* 1/2013 Shi ..... H01Q 1/521 343/833
2013/0050026 A1* 2/2013 Vin ..... H01Q 19/005 343/700 MS
2013/0207861 A1* 8/2013 Huang ..... H01Q 13/10 343/767
2014/0009342 A1* 1/2014 Wei ..... H01Q 9/04 343/700 MS
2014/0100004 A1 4/2014 Yarga et al.
2014/0266922 A1 9/2014 Jin et al.
2014/0266936 A1* 9/2014 Emmanuel ..... H01Q 9/42 343/725
2014/0354488 A1* 12/2014 Lee ..... H01Q 9/0421 343/702
2015/0054708 A1* 2/2015 Lin ..... H01Q 1/50 343/846
2015/0070239 A1 3/2015 Hung et al.
2015/0097753 A1* 4/2015 Liou ..... H01Q 5/40 343/867
2015/0155616 A1* 6/2015 Lin ..... H01Q 9/42 343/702
2015/0171518 A1* 6/2015 Lee ..... H01Q 9/42 343/843
2015/0270613 A1 9/2015 Toh et al.
2015/0303550 A1* 10/2015 Su ..... H01Q 7/00 343/702
2015/0333399 A1 11/2015 Huang et al.
2015/0372384 A1 12/2015 Liu et al.
2016/0020527 A1* 1/2016 Koga ..... H01Q 9/16 343/727
2016/0028150 A1* 1/2016 Chou ..... H01Q 9/42 343/702
2016/0043467 A1* 2/2016 Desclos ..... H01Q 5/328 343/745
2016/0164192 A1* 6/2016 Lin ..... H01Q 21/30 343/749

FOREIGN PATENT DOCUMENTS

| | | |
|---|---|---|
| CN | 102694261 | 9/2012 |
| CN | 204793200 | 11/2015 |
| GB | 2373637 | 9/2002 |
| TW | 201448348 A | 12/2014 |
| TW | 512223 | 11/2015 |

OTHER PUBLICATIONS

Chu, F-H et al, "Internal Coupled-Fed Dual-Loop Antenna Integrated with a USB Connector for WWAN/LTE Mobile Handset", Aug. 11, 2011.
Chu, F-H et al, "Internal Handset Antenna Integrated with USB Connector for WWAN/LTE Operation" Sep. 24, 2011.
Lin, C-H et al, "A Compact Experimental Planar Antenna with a USB Connector for Mobile Phone Application", Feb. 2015.
Wong, K-L et al, "A Small Size Penta-band WWAN Antenna Integrated with USB Connector for Mobile Phone Applications", Aug. 11-13, 2010.

* cited by examiner

ANTENNA PORTIONS

BACKGROUND

An antenna may be used to facilitate wireless communication. An antenna may be used in connection with a computing device to facilitate wireless communication of the computing device.

DETAILED DESCRIPTION

As computing device specifications change, space allocation within computing devices may change. For example, as mobile and/or portable computing devices (referred to generally herein as "computing devices") become smaller, thinner, and/or lighter, component placement within the device may present challenges. For example, challenges involving antenna placement may arise when an antenna associated with a computing device is disposed near a microphone, speaker, port (e.g., a universal serial bus), etc. of the computing device. Computing devices, as used herein include smartphones, phablets, handheld computers, personal digital assistants, carputers, wearable computers, laptops, tablet computers, laptop/tablet hybrids, etc.

In some examples, it may be desirable to provide wide- and multi-band antennas of computing devices. However, antenna design can be limited with such a size of antenna. In addition, for a computing device with a thin profile including a USB (Universal Serial Bus) port located on a bottom of the computing device, a volume of the computing device can be increased or radiation performance can be decreased. Increasing antenna volume can negatively affect industrial design of the computing design. Notably, examples described herein can allow a USB port to be used as a radiation structure in a particular orientation with respect to antenna components in order to avoid such negative outcomes.

Computing devices can include an antenna to send and/or receive signals. For example, an antenna can be used in conjunction with a computing device to facilitate voice and/or data transfer. In some examples, an antenna can be used in conjunction with a computing device to facilitate telephonic communication, web access, voice over IP, gaming, high-definition mobile television, video conferencing, etc. However, space constraints associated with some computing device form factors and/or some material choices may impact antenna placement and/or antenna performance.

Examples of the disclosure include methods, systems, and apparatuses employing an antenna. For example, a system may include a computing device and an antenna comprising a first antenna portion (e.g., a feeding arm), a second antenna portion (e.g., a parasitic arm), and a third antenna portion (e.g., a coupled arm). In some examples, the first antenna portion can be capacitively coupled to the second antenna portion and the first antenna portion can be capacitively coupled to the third antenna portion. In some examples, a system may further include a USB used as a radiating structure that grounds the third antenna portion (e.g., a coupled arm of the antenna).

Figure 1:
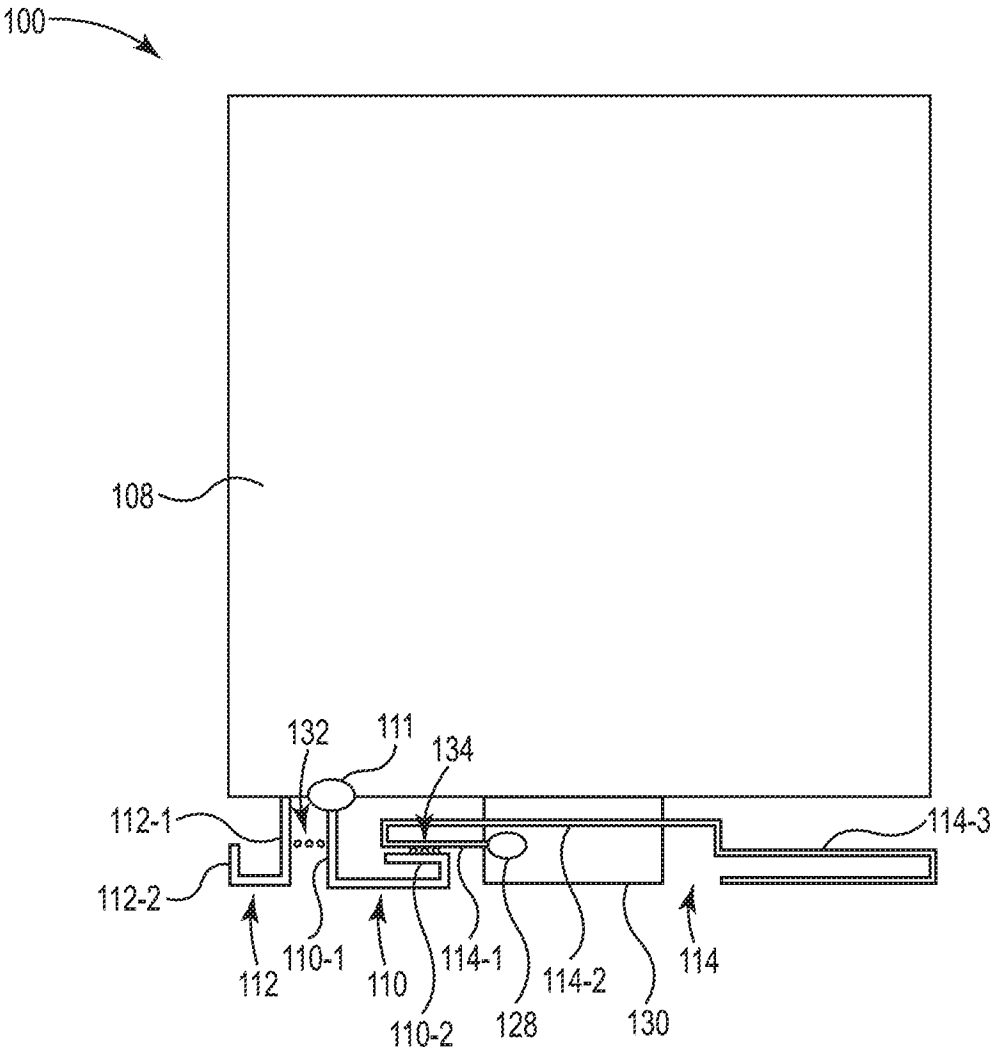
FIG. 1 illustrates a diagram of an example of a system according to the disclosure.

FIG. 1 illustrates a diagram of an example of a system 100 according to the present disclosure. As shown in the example of FIG. 1, the system 100 can include a first antenna portion 110 of an antenna, a second antenna portion 112 of the antenna, and a third antenna portion 114 of the antenna. The first antenna portion 110 includes a first portion 110-1 and a second portion 110-2. The first portion 110-1 can be in communication with a feed 111. The first antenna portion 110 can refer to a feeding arm of the antenna. The feeding arm can be excited directly by a radio frequency (RF) signal source. An RF signal source can include a source of a radio frequency. RF refers to any electromagnetic wave frequencies that lie in a range from around 3 kHz to 300 GHz. RF can refer to electrical oscillations.

The second antenna portion 112 includes a first portion 112-1 and a second portion 112-2. The second antenna portion 112 can refer to a parasitic arm of the antenna. The first portion 110-1 of the feeding arm and the first portion 112-1 of the parasitic arm can be capacitively coupled together, at 132. For example, a electromagnetic coupling field between the first portion 110-1 and the first portion 112-1 can allow the first portion 110-1 and the first portion 112-1 to be in electromagnetic (EM) communication. The EM communication between two portions of an antenna can be based on a particular distance and/or orientation of the two portions. For example, when a first portion 110-1 is a particular distance from a first portion 112-1, an EM communication can be a particular strength. In response to the two portions being further apart, the EM communication can be weakened and/or strengthened depending on the fields associated with the particular distance. The second antenna portion (e.g., parasitic arm) 112 capacitively coupled to the first antenna portion 110 creates multi-resonances in a high band of the RF signal source to expand the high band resonances created by the first antenna portion 110 and the third antenna portion 114 as will be further described herein.

A third antenna portion 114 includes a first portion 114-1, a second portion 114-2, and a third portion 114-3. A front end of the first portion 114-1 can be grounded 128 to a connector (e.g., Universal Serial Bus (USB) port) 130. The connector 130 may be a universal serial bus (USB), or other port or bus capable of providing communication and/or power supply to and/or from a computing device. The third antenna portion (e.g., coupled arm) 114 can be capacitively coupled to the first antenna portion 110 in order to create multi-resonances in a low band and a high band frequency ranges. The high band resonances created by the third antenna portion 114 is further expanded by the high band resonances created by the first antenna portion 110 and the second antenna portion 112.

At least a portion of the second antenna portion 112 and/or the third antenna portion 114 may be connected to a system ground 108 associated with a computing device. In some examples, the third antenna portion 114 can be in physical contact with port 130 connected to the system ground 108 The port may be a universal serial bus (USB), or other port or bus capable of providing communication and/or power supply to and/or from a computing device.

Figure 2:
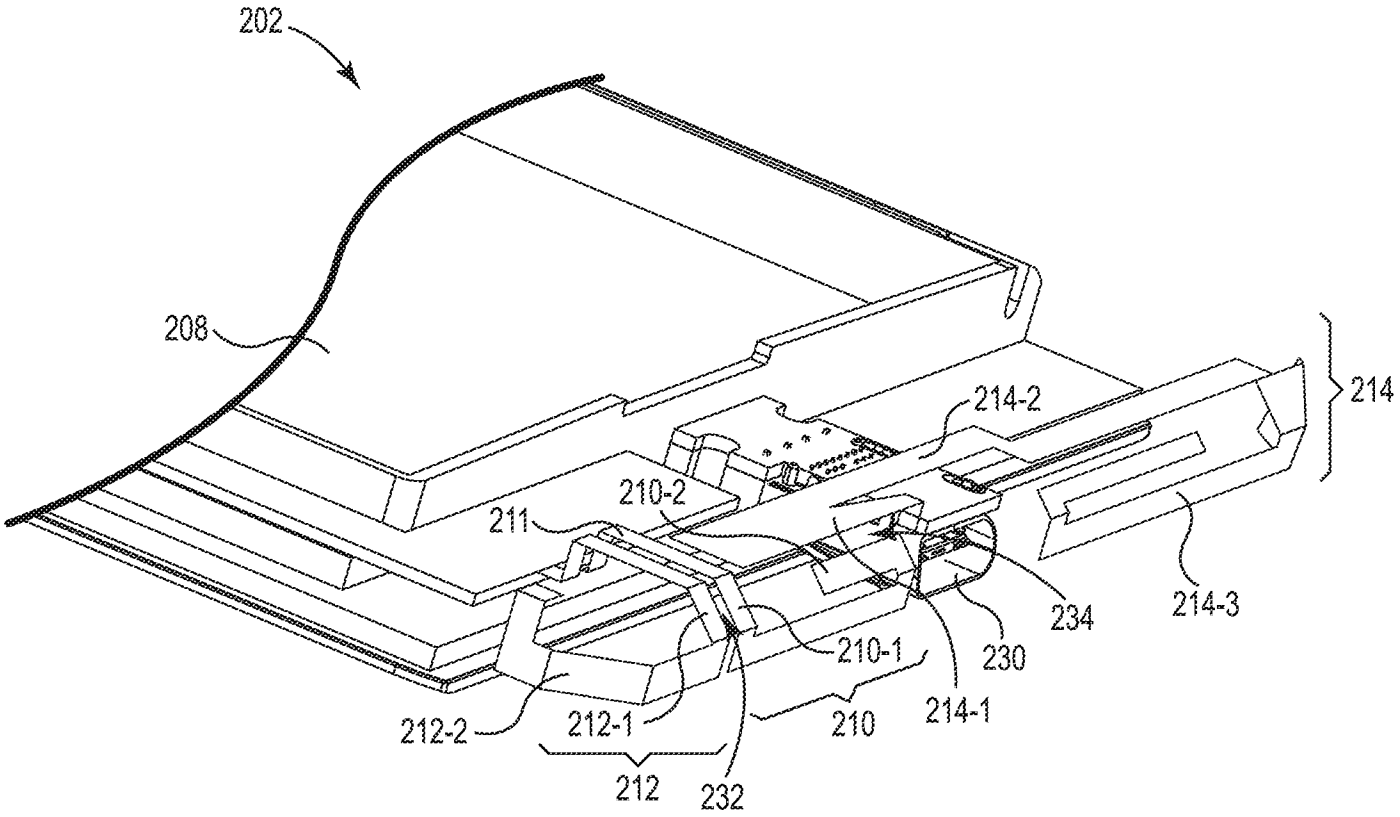
FIG. 2 illustrates a diagram of an example of a computing device including antenna portions according to the disclosure.

FIG. 2 illustrates a diagram of an example of a computing device including an antenna according to the disclosure. As shown in the example of FIG. 2, the computing device 202 can include a first antenna portion 210 of an antenna, a second antenna portion 212 of the antenna, and a third antenna portion 214 of the antenna. The first antenna portion 210 includes a first portion 210-1 and a second portion 210-2. The first portion 210-1 can start at a feed 211 and travel along the illustrated top portion of computing device 202, curve down at a general 90 degree turn (e.g., to result in a generally orthogonal relationship) and then travel sideways along a front side of the computing device 202. The first portion 210-1 forms an L, as illustrated, and continues as the second portion 210-2. The first portion 210-1 can be in communication with a feed 211. The section portion 210-2 curves back toward the first portion 210-1 in a sideways direction forming a "U." The first antenna portion 210 can refer to a feeding arm of the antenna. The feeding arm can be excited directly by a radio frequency (RF) signal source.

The second antenna portion 212 includes a first portion 212-1 and a second portion 212-2. The first portion 212-1 can travel along a top portion of the computing device 202, alongside the first portion 210-1, and curve similarly downward in a generally 90 degree turn along a front side of the computing device 202 (resulting in a generally orthogonal relationship, as illustrated). The first portion 212-1 can then turn sideways in a direction away from the first portion 210-1. The first portion 212-1 then turns into the second portion 212-2 and turns back in a generally 90 degree turn (e.g., two 45 degree turns, as illustrated, but not limited to these specific turns) to rejoin with a front side of the computing device 202. The second antenna portion 212 can refer to a parasitic arm of the antenna. The first portion 210-1 and the first portion 212-1 can be capacitively coupled together, at 232. For example, a capacitive field can allow the first portion 210-1 and the first portion 212-1 to be in communication by way of a capacitive field between them. The second antenna portion (e.g., parasitic arm) 212 capacitively coupled to the first antenna portion 210 creates multi-resonances in a high band of the RF signal source to expand the high band resonances created by the first antenna portion 210 and the third antenna portion 214.

A third antenna portion 214 includes a first portion 214-1, a second portion 214-2, and a third portion 214-3. The first portion 214-1 can travel along a top portion of the computing device 202 parallel and proximal to the second portion 210-2. A second portion 214-2 is a continuation of the first portion 214-1 after a 180 degree turn and/or pivot point where the second portion 214-2 travels away from the first antenna portion 210 and the second antenna portion 212. The second portion 214-2 also can travel over and alongside a top of the connector 230. The second portion 214-2 can make a downward path and continue to extend to a side of the computing device.

The third portion 214-3 can be a continuation of the second portion 214-2 and make two sharp 90 degree turns at the side of the computing device 202 and then turns back towards the connector 230 before forming a U and turning back toward the side, as illustrated. The first portion 214-1 can be grounded to a connector (e.g., Universal Serial Bus (USB) port) 230. The connector 230 may be a universal serial bus (USB), or other port or bus capable of providing communication and/or power supply to and/or from a computing device. The third antenna portion (e.g., coupled arm) 214 can be capacitively coupled, at 234 to the first antenna portion 210 in order to create multi-resonances in a low band and a high band frequency ranges. The high band resonances created by the third antenna portion 214 is further expanded by the high band resonances created by the first antenna portion 210 and the second antenna portion 212.

Figure 3:
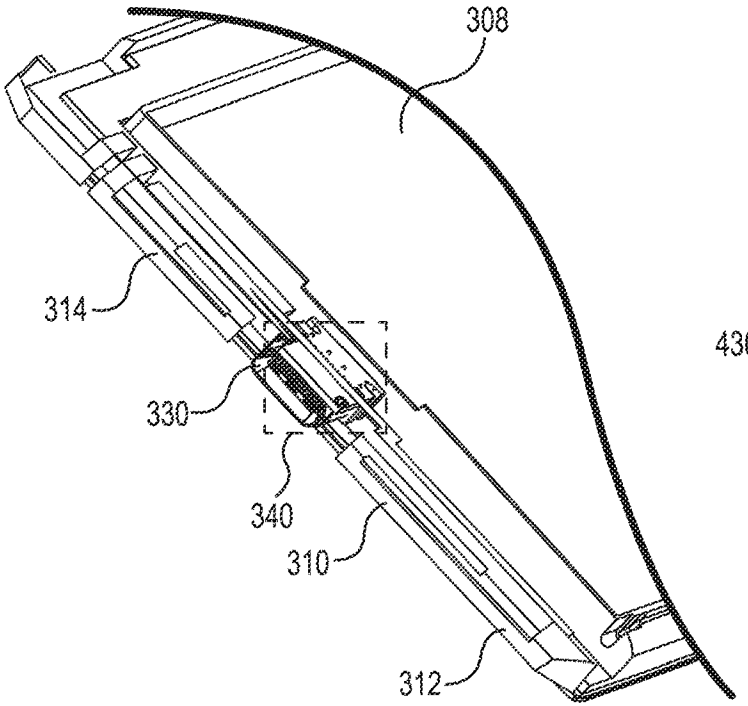
FIG. 3 illustrates a diagram of an example of a computing device including antenna portions according to the disclosure.

FIG. 3 illustrates a diagram of an example of a computing device including an antenna according to the disclosure. As shown in the example of FIG. 3, the computing device can be similar and mirror the computing device 202 in FIG. 2. For example, as illustrated in FIG. 2, the second antenna portion 212 is illustrated on a left side of the computing device 202. In FIG. 3, the second antenna portion 312 is illustrated on the right. The antenna portions can be placed in a particular location based on a number of other components (e.g., USB ports, metal components, speaker systems, etc.) in order to maximize efficiency of the antenna, minimize interference, etc. A first antenna portion 310 is located to the right of connector 330 and the third antenna portion 314 is illustrated to the left of the connector 330. The second antenna portion 312 is on the right-most edge of the computing device.

The first antenna portion 310 can be capacitively coupled to the second antenna portion 312. The first antenna portion 310 can be capacitively coupled to the third antenna portion 314. Even though antenna components are rearranged and/or flipped from one side to another, the couplings and/or interactions can be the same as those described in association with FIG. 2. A window 340 of FIG. 3 can be expanded as 440 in FIG. 4.

Figure 4:
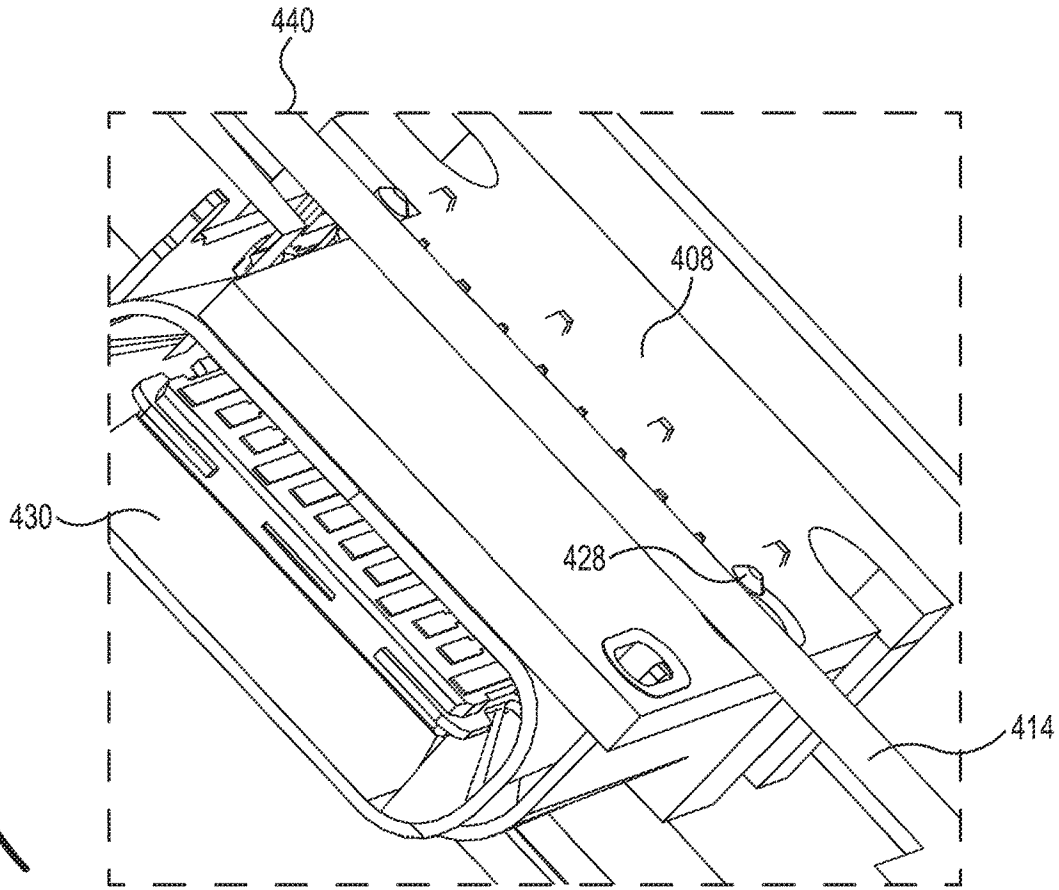
FIG. 4 illustrates a diagram of an example of a computing device including antenna portions according to the disclosure.

FIG. 4 illustrates a diagram of an example of a portion 440 of a computing device including an antenna. The antenna can include a portion 414 (e.g., third antenna portion 214 and 314 in FIGS. 2 and 3) that is grounded, at 428, to a connector 430. The connector 430 can be a Universal Serial Bus (USB) port. The USB can be coupled to a PCB 408.

Figure 5:
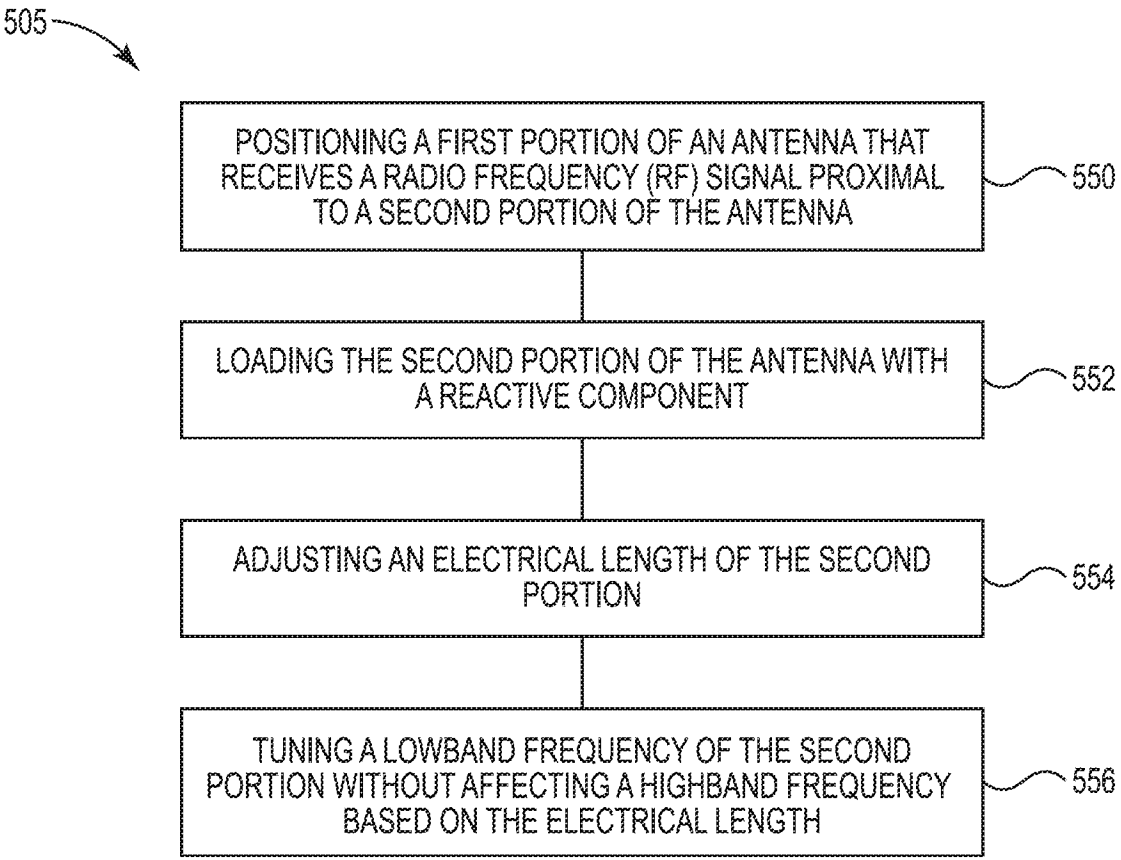
FIG. 5 illustrates a flow diagram of an example of a method for antenna portions according to the disclosure.

FIG. 5 illustrates a flow diagram of an example of a method 505 for an antenna according to the disclosure. At 550, the method 505 can include positioning a portion of an antenna that receives a radio frequency (RF) signal proximal to an additional portion of the antenna. The additional portion of the antenna (e.g., third antenna portion 314 in FIG. 3) can be located next to the portion that receives the RF signal to capacitively couple them together.

At 552, the method 505 can include loading the additional portion of the antenna with a reactive component (e.g., at 428 in FIG. 4). The additional portion can be loaded with a capacitor and/or an inductor instead of being grounded. A number of reactive components can be loaded onto the additional portion. The number of reactive components can be associated with a level of adjustment of the low band resonance adjustments. Low band resonance adjustments can be adjustments to a low band frequency. In some examples, low band frequency can refer to radio frequencies in the range of 700 MHz-1 GHz.

At 554, the method 505 can include adjusting an electrical length of the additional portion. The adjusting of the electrical length can affect a low band resonance frequency range. At 556, the method 505 can include tuning a low band frequency of the additional portion. For example, a length of the coupled arm (such as an electrical length) can be a main tuning parameter for a low band frequency. Tuning of the low band frequency can be performed without affecting a high band frequency. Tuning can include amplifying RF oscillations within a particular frequency band and/or bands. Tuning can include reducing oscillations at other RF frequencies outside the particular frequency band and/or bands.

In some examples, the method can include capacitively coupling a portion of the antenna (e.g., a feeding arm) to an additional portion (e.g., a parasitic arm). In some examples, the method can include positioning a third portion (e.g., a coupled arm) of the antenna proximal to the portion (e.g., a feeding arm). The method can include capacitively coupling the third portion (e.g., the coupled arm) to the portion (e.g., the feeding arm). The method can include using a reactive component that is a capacitor. In some examples, the method can include using a reactive component that is an inductor. Use of a capacitor or an inductor can allow adjustment of the low band frequency.

In this way, the present disclosure describes a unique antenna structure that uses a USB port as a radiation structure to overcome possible negative radiation performance due to a USB port assembly. In addition, a low-profile configuration can be setup using the particular configurations and/or orientations of the portions of the antenna described above. This allows for a broader range of industrial designs for the computing device. In addition, a wider bandwidth is achieved.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure.

The figures herein follow a numbering convention in which the first digit corresponds to the drawing figure number and the remaining digits identify an element or component in the drawing. For example, reference numeral 110 may refer to element "10" in FIG. 1 and an analogous element may be identified by reference numeral 210 in FIG. 2. Elements shown in the various figures herein can be added, exchanged, and/or eliminated so as to provide a number of additional examples of the disclosure. In addition, the proportion and the relative scale of the elements provided in the figures are intended to illustrate the examples of the disclosure, and should not be taken in a limiting sense. Further, as used herein, "a number of" an element and/or feature can refer to one or more of such elements and/or features.

As used herein, "substantially" and/or "generally" refers to a characteristic that is close enough to the absolute characteristic to achieve the same functionality. For example, substantially orthogonal directions can be directions that, even if not aligned perfectly at 90 degrees, are close enough to 90 degrees to achieve the characteristic of being at 90 degrees.

What is claimed:

1. An antenna system, comprising:

a first antenna portion of the antenna to receive a radio frequency (RF) signal, the first antenna portion comprising:

a first portion extending from a feed a first distance along a first surface of a device;

a second portion extending perpendicular to the first portion along a second surface of the device, wherein the second portion curves back and extends a third distance along the first surface;

a second antenna portion of the antenna capacitively coupled to the first antenna portion, wherein the capacitive coupling of the second portion to the first portion increases the high-band resonances;

a third antenna portion, that is a continuation of the second antenna portion, of the antenna connected to a connector, wherein:

the third antenna portion is capacitively coupled to the first antenna portion to excite wide low-band resonances and high-band resonances; and the connector is a Universal Serial Bus (USB) port that is a ground for the third antenna portion.

2. The antenna system of claim 1, wherein the first antenna portion is a feeding arm of the antenna.

3. The antenna system of claim 1, wherein the second antenna portion is a parasitic arm of the antenna.

4. The antenna system of claim 1, wherein the third antenna portion is a coupled arm of the antenna system.

5. The antenna system of claim 1, wherein the connector is used as a radiating structure of the antenna system.

6. A computing device, comprising:

an antenna, wherein the antenna comprises:

a feeding arm to receive a radio frequency (RF) signal, the feeding arm comprising:

a first portion of the feeding arm extending from a feed a first distance along a first surface of the computing device;

a second portion of the feeding arm extending perpendicular to the first portion along a second surface of the computing device, wherein the second portion curves back and extends a third distance along the first surface;

a parasitic arm, wherein a first portion of the parasitic arm is proximal to the feeding arm and a second portion of the parasitic arm is proximal to a coupled arm;

a coupled arm, that is a continuation of the parasitic arm, connected to a connector that is a Universal Serial Bus (USB) port such that the connector grounds the coupled arm, wherein:

a first portion of the coupled arm grounded to the connector is proximal to the feeding arm;

a second portion of the coupled arm travels over a side portion of the connector; and a third portion of the coupled arm distal to the feeding arm.

7. The computing device of claim 6, wherein the first portion of the parasitic arm is capacitively coupled to the feeding arm.

8. The computing device of claim 6, wherein the second portion of the parasitic arm is capacitively coupled to the coupled arm.

9. The computing device of claim 6, wherein the coupled arm, and the parasitic arm are curved around an edge portion of the computing device.

10. A method, comprising:

positioning a feeding arm of an antenna that receives a radio frequency (RF) signal proximal to a parasitic arm of the antenna, the feeding arm comprising:

a first portion of the feeding arm extending from a feed a first distance along a first surface of a device;

a second portion of the feeding arm extending perpendicular to the first portion along a second surface of the device, wherein the second portion curves back and extends a third distance along the first surface;

loading the parasitic arm of the antenna with a reactive component;

adjusting an electrical length of the parasitic arm; and tuning a lowband frequency of parasitic arm without affecting a highband frequency based on the electrical length, wherein the parasitic arm is proximal to a coupled arm; and connecting the coupled arm to a connector that is a Universal Serial Bus (USB) port such that the connector grounds the coupled arm.

11. The method of claim 10, comprising capacitively coupling the feeding arm to the parasitic arm.

12. The method of claim 10, comprising positioning a coupled arm of the antenna proximal to the feeding arm.

13. The method of claim 12, comprising capacitively coupling the coupled arm to the feeding arm.

14. The method of claim 10, wherein the reactive component is one of a capacitor and an inductor.

* * * * *